US006206789B1

(12) United States Patent
Takeda

(10) Patent No.: US 6,206,789 B1
(45) Date of Patent: Mar. 27, 2001

(54) GOLF CLUB

(75) Inventor: Hitoshi Takeda, Tsubame (JP)

(73) Assignee: K.K. Endo Seisakusho, Niigata-ken (JP)

( * ) Notice: Subject to any disclaimer, the term of this patent is extended or adjusted under 35 U.S.C. 154(b) by 0 days.

(21) Appl. No.: 09/340,308

(22) Filed: Jun. 28, 1999

(30) Foreign Application Priority Data

Jul. 9, 1998 (JP) ..... 10-194299

(51) Int. Cl.[7] ..... A63B 53/04; A63B 53/06; A63B 53/08

(52) U.S. Cl. ..... 473/335; 473/338; 473/349

(58) Field of Search ..... 473/345, 346, 473/349, 332–339

(56) References Cited

U.S. PATENT DOCUMENTS 5,056,705 * 10/1991 Wakita et al. ..... 228/176
5,967,905 * 10/1999 Nakahara et al. ..... 473/345
6,001,032 * 12/1999 Onuki et al. ..... 473/342

FOREIGN PATENT DOCUMENTS 63-154186 6/1988 (JP) .
2606628 2/1997 (JP) .

* cited by examiner

*Primary Examiner*—Jeanette Chapman
*Assistant Examiner*—Sneh Varma
(74) *Attorney, Agent, or Firm*—Quarles & Brady LLP

(57) ABSTRACT

A golf club such as so-called metal wood, enabling a separate balance weight to be joined easily and firmly to a head body made of titanium or titanium alloy. A receiving base 22 made of titanium or titanium alloy is provided between a balance weight 21 and a body shell member 18 which forms the head body. The balance weight 21 is joined to the receiving base 22 by caulking, then the receiving base 22 is welded to the inside face of the body shell member 18. Thus, in welding the balance weight 21 to the body shell member 18, there is no longer any limitation to the material of the balance weight 21. In a preferred form of the invention, the balance weight 21 is caulked to the receiving body by pressing the balance weight 21 into a recess 24 formed in the receiving base 22, with a claw portion 25 formed in the receiving base 22 cutting into the balance weight 21.

8 Claims, 4 Drawing Sheets

GOLF CLUB

BACKGROUND OF INVENTION

1. Field of Invention

The present invention relates to a golf club, particularly to a golf club having a weight secured to a head body.

2. Prior Art

For example, a head of a wood club called metal wood is hollow, made of metallic materials. To manufacture such wood club head, a majority portion of a club head is constructed by casting, using a method such as lost wax, or otherwise, it is constructed from a few shell members, each being formed by pressing, then these shell members are joined together by welding or the like. To lighten a head and enlarging the same through the lightening thereof, titanium or titanium alloy has been used as metal materials.

In order to set various properties of a golf club, it is important to distribute the weight to respective portions of a head. For example, to enlarge a sweet area where a hit ball travels well and comparatively straight, said sweet area being positioned on a face or a ball hitting face at a front of a head, it is appropriate to enlarge a distance between the face and the center of gravity of a whole head (i.e., a depth of the center of gravity) or to disperse the weight toward the periphery of the face. To enable a hit ball to be raised easily so as to elongate a travelling distance, you may lower the center of gravity of a whole head. Further, a hit ball has a tendency to slice or hook, depending upon whether the position of the center of gravity of the whole head is located relatively close to a toe or a heel. You may take advantage of such tendency so as to correct a player's slicing or hooking habit. Besides, setting the weight distribution relative to each portion of a club head has a delicate influence on a feeling in hitting, and so on.

However, it is difficult to drastically vary a thickness per each shell if the shells are constructed by casting or forging only, and thus there has been a limit to the setting of the weight distribution relative to each portion of a club head. Conventionally, as disclosed in Japanese Un-Examined Patent Publication No.63-154186 for example, a balance weight which is separate from shells that construct a head body, has been joined to the inside face of the shell by welding or the like. Welding has been widely employed for joining such balance weight to the shell, due to it resulting in easy work and high joining strength. In the case of employing welding, however, the material of the shell member basically needs to be the same as that of the balance weight. For example, if the material of the shell member is titanium or titanium alloy, the material of the balance weight also must be titanium or titanium alloy. In that case, as titanium or titanium alloy is a lightweight material, it is difficult to obtain a sufficient effect of weight distribution by using such balance weight of titanium or titanium alloy.

On the other hand, if screwing or caulking is employed as a joining means, there would be no restriction on material. However, in the case of screwing, there is a likelihood to impair an appearance, as screws are exposed to the external. In the case of caulking also, caulking are often unable to be carried out due to a narrow inside and particular shape of a club head.

Whereas, in Japanese Patent Registered Publication No. 2606628 is proposed that a balance weight (weight body) of copper alloy or the like is screwed to a receiving base (weight base) of titanium alloy, then said receiving base is joined to a shell member (head body member) of titanium alloy by welding. With this construction, there is no restriction on weight material, while the balance weight screwed to the receiving base beforehand can be joined to the shell member by welding. However, since a means for joining the balance weight to the receiving body is screwing, the employment of screws that are separate from the balance weight and the receiving base would result in the increased number of components and the increased costs. Even if the screws are formed integrally with the balance weight, yet there would be problems that processing is made more complicated.

SUMMARY OF THE INVENTION

To eliminate the above problems, it is, therefore, an object of the invention to provide a golf club whose balance weight is made of a material different from that of a head body and yet is able to be easily and securely fixed to the head body formed of titanium or titanium alloy.

To attain the above object, there is provided a golf club incorporating a head having a shaft connected to one side and a face on a front, wherein said head comprises: a head body formed of titanium or titanium alloy; a balance weight fixed to an inside of said head body, said balance weight being formed of a material whose specific gravity is different from that of said head body; and a receiving base formed of titanium or titanium alloy which is provided between said head body and said balance weight, wherein said receiving body is joined to said head body by welding, while said receiving body is joined to said balance weight by caulking each other.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DETAILED DESCRIPTION OF THE PREFERRED EMBODIMENTS

Figure 1:
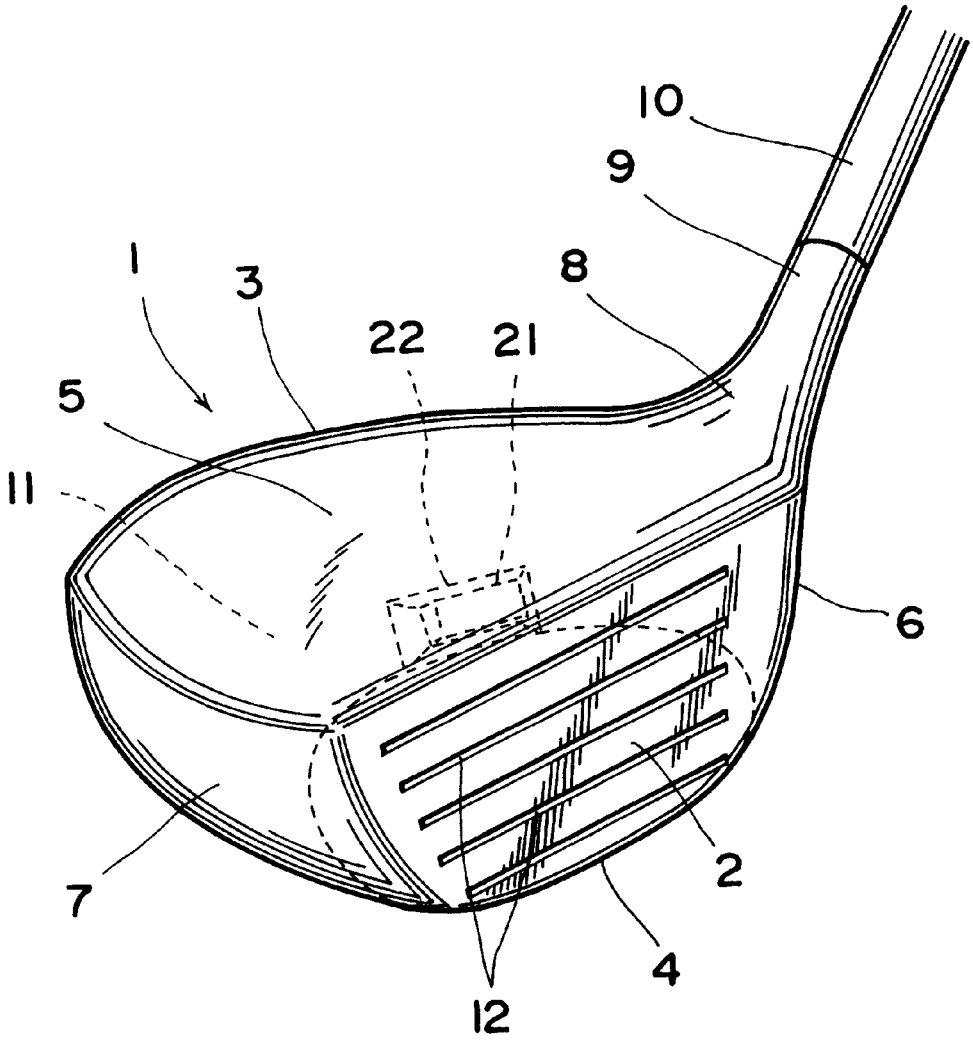
FIG. 1 is a perspective view showing a whole head of a first embodiment of a golf club according to the present invention.
Figure 2:
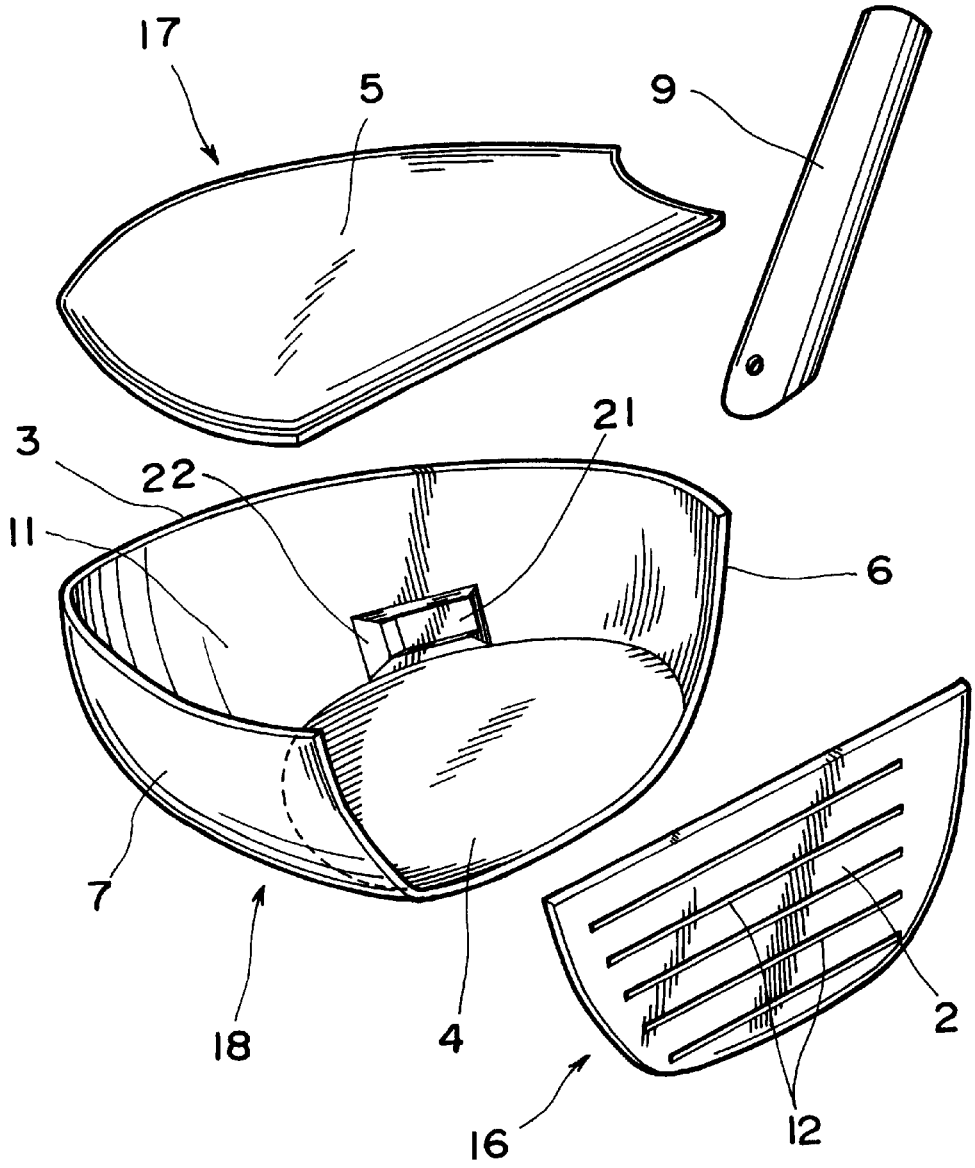
FIG. 2 is an exploded perspective view showing the whole head shown in FIG. 1.
Figure 3:
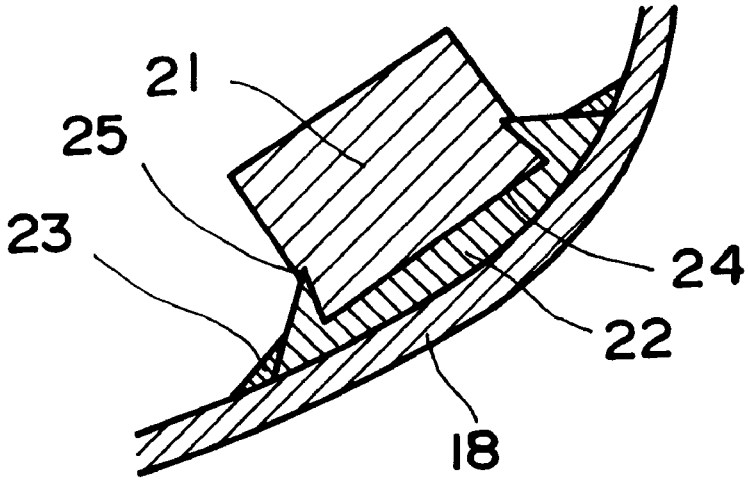
FIG. 3 is a cross-sectional view showing the head of a first embodiment, illustrating the vicinity of a balance weight of a golf club according to the invention.

Hereinafter is explained a first embodiment of a golf club of the invention with reference to FIG. 1 through FIG. 3. A golf club of the present embodiment is a wood club, having a hollow, metallic head, called metal wood. The head 1 has, as shown in FIG. 2, a face 2 serving as a hitting face at its front, a back 3 at its rear side, a sole 4 at its lower side, a top 5 at its upper side, a heel 6 at one side, and a toe 7 at the other side, respectively. The upper side of the heel 6 is formed with a neck 8, from which extends upwardly a hosel 9. The hosel 9 serves as a shaft-joining portion for joining a shaft 10 thereto. The head 1 has a hollow portion 11 inside, which is filled with a filler such as polyurethane or the like. The face 2 is formed with a plurality of grooved portions called score lines 12.

Said head 1 is constructed of a face shell member 16 which mainly forms the face 2, a top shell member 17 which mainly forms the top 5, the hosel 9 which is pipe-shaped, and a body shell member 18 which forms the remaining portion of the head 1. These face shell member 16, top shell member 17, hosel 9 and body shell member 18 are each formed by means of forging or casting, which are fixed to one another by means of welding or the like. It is to be noted that the face shell member 16, top shell member 17 and body shell member 18 which construct a head body are made of titanium or titanium alloy.

Inside said head 1, the body shell member 18 is provided with a balance weight 21 which is positioned on the back 3 side near the sole 4 thereof. The balance weight 21 is made of a material whose specific gravity is different, or preferably greater than that of titanium or titanium alloy which is the material for the body shell member 18 that constructs the head body. For such material for the balance weight 21, copper-based materials such as beryllium-copper alloy, copper-tungsten alloy or the like, iron-based materials such as stainless steel, or other suitable materials such as lead, may be used. For some of the above-mentioned materials, the specific gravity is shown by way of example as follows: iron: 7.87; SUS304 (stainless steel): 7.9; copper: 8.96; beryllium-copper: 8.26; pure titanium: 4.5; titanium alloy: about 4.45–5.01.

The balance weight 21 is fixed to the body shell member 18 through the receiving base 22 which is formed of titanium or titanium alloy, i.e., the same material as that of the body shell member 18. The balance weight 21 is joined to the receiving base 22 by caulking, while the receiving base 22 is joined to the body shell member 18 by welding. In the drawing, reference numeral 23 designates a welding part. To ensure the joining of the receiving base 22 to the body shell member 18, a proximal end face of said receiving base 22 to be welded to the body shell member 18 is formed so as to substantially conform to the inside surface of the body shell member 18. The receiving base 22 is truncated-pyramid-shaped, which tapers from the side of the proximal end face toward the opposite distal end, thus enabling a welding work to be performed more easily inside the narrow body shell member 18.

To join the balance weight 21 to the receiving base 22 by caulking, the receiving base 22 is formed with a recess 24 for press-fitting and caulking a part of the balance weight 21 thereinto. Further, the inside top periphery of the recess 24 is formed with a claw portion 25 which is to cut into the external peripheral surface of the balance weight 21. When manufacturing, the balance weight 21 is pressed into the recess 24 of the receiving base 22 by pressing. At this time, the balance weight 21 and the receiving base 22, specifically the balance weight 21 that is softer than the hard receiving base 22 made of titanium or titanium alloy is subjected to plastic deformation, so that the claw portion 25 of the receiving base 22 is allowed to cut into the balance weight 21, whereby the receiving base 22 is firmly joined to the balance weight 21 by caulking each other. Alternatively, the claw portion 25 of the receiving base 22 may be plastically deformed to cut into the balance weight 21 after fitting the balance weight 21 into the recess 24 of the receiving base 22. Subsequently, the receiving base 22 is joined to the body shell member 18 by welding. As the receiving base 22 is made of the same material as that of the body shell member 18, no welding problems occur. Then, the body shell member 18 is joined to the remaining shell members 16, 17 by welding.

According to the structure of the foregoing embodiment, as the receiving base 22 formed of titanium or titanium alloy is provided between the body shell member 18 formed of titanium or titanium alloy and the balance weight 21, the balance weight 21 formed of the material which can not be welded directly to titanium or titanium alloy is able to be fixed to the body shell member 18 by welding, through the welding of the receiving base 22 having such balance weight 21 joined thereto beforehand to the body shell member 18. Consequently, there is no longer any limitation to the material of the balance weight 21, and thus you can use materials of comparatively large specific gravity. Accordingly, you are more freely able to set the weight distribution. Furthermore, as the balance weight 21 can be fixed to the body shell member 18 by welding, the fixing work for fixing the balance weight 21 to the body shell member can be comparatively easily performed.

Also, as the balance weight 21 is joined to the receiving base 22 by caulking, they can be joined to each other comparatively easily, with a required strength being ensured. Further, as it is not necessary to use separate components such as screws for joining purpose, costs can be reduced. Furthermore, as it is not necessary to perform tapping or the like, processing works can be comparatively simplified. Moreover, as the balance weight 21 is caulked with the receiving base 22 in such a manner that the balance weight 21 is pressed into the recess 24 formed in the receiving base 22, a joining area for joining the receiving base 22 to the balance weight 21 can be enlarged. Additionally, as the claw portion 25 formed on the receiving base 22 made of high-strength titanium or titanium alloy is allowed to cut into the balance weight 21, a joining condition between the receiving base 22 and the balance weight 21 can be further insured.

In addition to the foregoing, as the balance weight 21 is provided at the position on the back 3 side of the head 1, the center of gravity of the whole head 1 can be located further rearwardly and away from the face 2, thereby enabling the enlarging of a sweet area. Also, as the balance weight 21 is provided close to the sole 4 side of the head 1, the center of gravity of the head 1 can be lowered, and the travelling distance can be elongated. In other words, particularly for inexperienced players, they tend to hit a ball at a point lower than the center of gravity of the head 1, and thus the ball is not raised sufficiently, thus often resulting in shorter travelling distances. Through the lowered center of gravity, such tendency of inexperienced players can be remedied, and the travelling distances also can be elongated.

Figure 4:
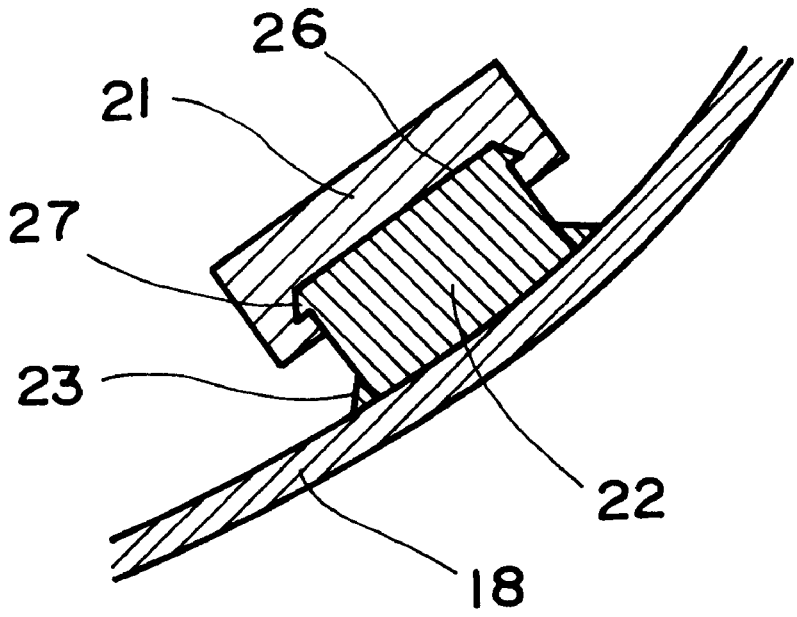
FIG. 4 is a cross-sectional view showing the vicinity of a balance weight of a second embodiment of a golf club according to the invention.

As follows is explained a second embodiment of the invention with reference to FIG. 4. The same portions as those described in the foregoing embodiment are denoted by the same reference numerals and their repeated descriptions will be omitted.

In a second embodiment, a recess 26 is formed not in the receiving base 22 which is made of titanium or titanium alloy and welded to the body shell member 18, but in the balance weight 21. The balance weight 21 is then joined to the receiving base 22 by pressing a part of the receiving base 22 into the recess 26. An outside top periphery of the receiving base 22 is formed with a claw portion 27, which projects outwardly, and is forced to cut into the balance weight 21 within the recess 26. The manufacturing method is the same as said first embodiment. Alternatively, the receiving body 22 may be first fitted into the recess 26 of the balance weight 21, then the weight 21 may be plastically deformed to cover the claw portion 27 of the receiving body 22.

In the second embodiment also, the same effects as said first embodiment are obtained. According to the second embodiment, however, there is another advantage that the size of the balance weight 21 is not limited by the receiving base 22, so that the balance weight 21 can be enlarged. On the other hand, its working efficiency for welding the receiving base 22 to the body shell member 18 is inferior to that of the first embodiment. However, such inferior working efficiency can be improved if the proximal end face of the receiving base 22 welded to the body shell member 18 is formed so wide that the proximal end face may be positioned outside of the outer periphery of the balance weight 21.

Incidentally, the present invention should not be limited to the foregoing embodiments, but may be variously modified. For example, although the head 1 is constructed of three separate shell members 16, 17 and 18 in the foregoing embodiments, the construction of the head 1 should not be limited thereto. For example, the head may be constructed of two separate shell members: one shell member constructing the sole and the other constructing the remaining parts.

Further, the position in which the balance weight is provided should not be limited to that of the foregoing embodiments. It should be noted that by adjusting the mounting position of the balance weight, there can be provided a golf club having various specific properties, such as those for enlarging a sweet area, elongating a travelling distance by lowering the center of gravity, correcting slicing or hooking habit, and etc.

Although a golf club of the invention is explained, taking an example of a wood club in the foregoing embodiments, the present invention is applicable to an iron club or a putter of a hollow construction. Further, the head should not be limited to a hollow one, and thus the invention is also applicable to a head which has a balance weight fixed to a cavity formed at the back thereof.

What is claimed:

1. A golf club incorporating a hollow head having a shaft connected to one side and a face on a front, wherein said head comprises:

a head body formed of titanium or titanium alloy;

a balance weight fixed to an inside of said head body, said balance weight being formed of a material which is softer than that of said head body, and whose specific gravity is different from that of said head body; and a receiving base formed of titanium or titanium alloy which is provided between said head body and said balance weight, said receiving base having a proximal end face which is so formed that it substantially conforms to an inside surface of the head body; and wherein said receiving base is joined to said head body by a weld between the proximal end face of the receiving base and the inside surface of the head body, while said receiving base is formed with a claw portion and joined to said balance weight by caulk, said claw portion cutting into said balance weight.

2. A golf club as claimed in claim 1, wherein the specific gravity of the material for said balance weight is larger than that of said head body.

3. A golf club as claimed in claim 1, wherein a recess is formed in said receiving base, wherein said balance weight is pressed into said recess, and wherein the balance weight and the receiving body are joined to each other by caulk.

4. A golf club as claimed in claim 3, wherein a claw portion is formed in an inside top periphery of said recess, said claw portion being allowed to cut into an outside periphery of said balance weight.

5. A golf club as claimed in claim 3, wherein said receiving base is formed into a shape of a truncated pyramid which tapers from a proximal end face thereof to an opposite distal end.

6. A golf club as claimed in claim 1, wherein a recess is formed in said balance weight, wherein said receiving base is pressed into the recess, and wherein said balance weight is joined to said receiving base by caulk.

7. A golf club as claimed in claim 6, wherein a claw portion is formed in a top periphery of the receiving base, so that said claw portion is allowed to cut into said balance weight within said recess.

8. A golf club as claimed in claim 1, wherein said balance weight is formed of one of copper, beryllium-copper alloy, tungsten alloy, iron, stainless steel and lead.

* * * * *